US012601354B2

(12) United States Patent
Butala

(10) Patent No.: US 12,601,354 B2
(45) Date of Patent: Apr. 14, 2026

(54) PATIO CHAIR FAN ASSEMBLY

(71) Applicant: Rocky Butala, Vanier (CA)

(72) Inventor: Rocky Butala, Vanier (CA)

( * ) Notice: Subject to any disclaimer, the term of this patent is extended or adjusted under 35 U.S.C. 154(b) by 180 days.

(21) Appl. No.: 18/640,700

(22) Filed: Apr. 19, 2024

(65) Prior Publication Data

US 2025/0327463 A1 Oct. 23, 2025

(51) Int. Cl.
*F04D 25/08* (2006.01)
*A47C 7/74* (2006.01)
*F04D 25/06* (2006.01)

(52) U.S. Cl.
CPC ..... *F04D 25/08* (2013.01); *A47C 7/744* (2013.01); *F04D 25/06* (2013.01)

(58) Field of Classification Search
CPC ..... F04D 25/08; F04D 25/06; F04D 25/0673; F04D 25/084; A47C 7/744; A47C 7/742; A47C 7/74
See application file for complete search history.

(56) References Cited

U.S. PATENT DOCUMENTS

| | | | |
|---|---|---|---|
| 3,295,886 | A | 1/1967 | Goldmerstein |
| D325,432 | S | 4/1992 | Cook |
| 7,866,743 | B1 | 1/2011 | Russell |
| 7,878,585 | B2 | 2/2011 | Salisbury |
| 9,173,500 | B2 | 11/2015 | Squires |
| 10,021,988 | B2 | 7/2018 | Samuels |
| 11,432,655 | B2 | 9/2022 | Garner |
| 2013/0328359 | A1 | 12/2013 | Antonov |

FOREIGN PATENT DOCUMENTS

| | | | | |
|---|---|---|---|---|
| CN | 201150379 Y | * | 11/2008 | ..... A47C 7/744 |
| CN | 203378790 U | * | 1/2014 | ..... A47C 7/744 |
| CN | 203468045 U | * | 3/2014 | ..... A47C 7/744 |
| CN | 204015695 U | * | 12/2014 | ..... A47C 7/744 |
| CN | 108577317 A | * | 9/2018 | ..... A47C 7/00 |

OTHER PUBLICATIONS

CN108577317.*
CN201150379.*
CN203378790.*
CN203468045.*
CN204015695.*

* cited by examiner

*Primary Examiner* — Joshua J Michener
*Assistant Examiner* — Cindi M Curry

(57) ABSTRACT

A patio chair fan assembly for cooling a user who is sitting on patio furniture includes a chair having a plurality of support sections. Each support section has an opening. A fan is removably couplable to the chair. The fan is aligned with the opening in a selectable one of the plurality of support sections to direct air through the opening in the selectable one of the plurality of support sections. The fan includes a housing having a front wall, a rear wall, and an interior space. A rotational motor is positioned in the interior space. A plurality of fan blades is positioned in the interior space. The rotational motor rotates the plurality of fan blades. A plurality of cutouts extending through the housing is aligned with the plurality of fan blades. Rotation of the plurality of fan blades directs air through the plurality of cutouts.

20 Claims, 15 Drawing Sheets

PATIO CHAIR FAN ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to fans and more particularly pertains to a new fan for cooling a user who is sitting on patio furniture.

(2) Description of Related Art Including Information Disclosed Under 37 CFR 1.97 and 1.98

The prior art relates to fans. Fans are commonly used in both indoor and outdoor spaces to provide increased airflow and to cool down users. The prior art discloses portable fans that the user can carry with them on the go. Such portable fans can be particularly useful when sitting outside in hot temperatures. For example, a user may bring a portable fan to the beach, or a sporting event, to provide some relief from the heat of the summer sun. At the beach or the sporting event, the user might rest in a lawn chair or on other patio furniture. The user typically needs to hold the portable fan themselves, which can be inconvenient if the user is trying to engage in other activities requiring the use of the user's arms or hands. Thus, there is a need in the art for a portable fan that can be attached to patio furniture for cooling the user while the user rests in the furniture.

BRIEF SUMMARY OF THE INVENTION

An embodiment of the disclosure meets the needs presented above by generally comprising a chair having a plurality of support sections. Each support section of the plurality of support sections has an opening. A fan is removably couplable to the chair. The fan is aligned with the opening in a selectable one of the plurality of support sections wherein the fan is configured to direct air through the opening in the selectable one of the plurality of support sections. The fan further comprises a housing having a front wall, a rear wall, and an interior space. A power source is positioned in the interior space. A processor is electrically coupled to the power source. A rotational motor is positioned in the interior space. The rotational motor is electrically coupled to the processor wherein the processor actuates the rotational motor. A plurality of fan blades is positioned in the interior space. The plurality of fan blades is coupled to the housing. The plurality of fan blades is mechanically coupled to the rotational motor wherein actuation of the rotational motor rotates the plurality of fan blades. A plurality of cutouts extends into the rear wall and outwardly through the front wall. The plurality of cutouts is aligned with the plurality of fan blades wherein rotation of the plurality of fan blades is configured to direct air inwardly through the plurality of cutouts positioned within the rear wall and outwardly through the plurality of cutouts positioned within the front wall.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
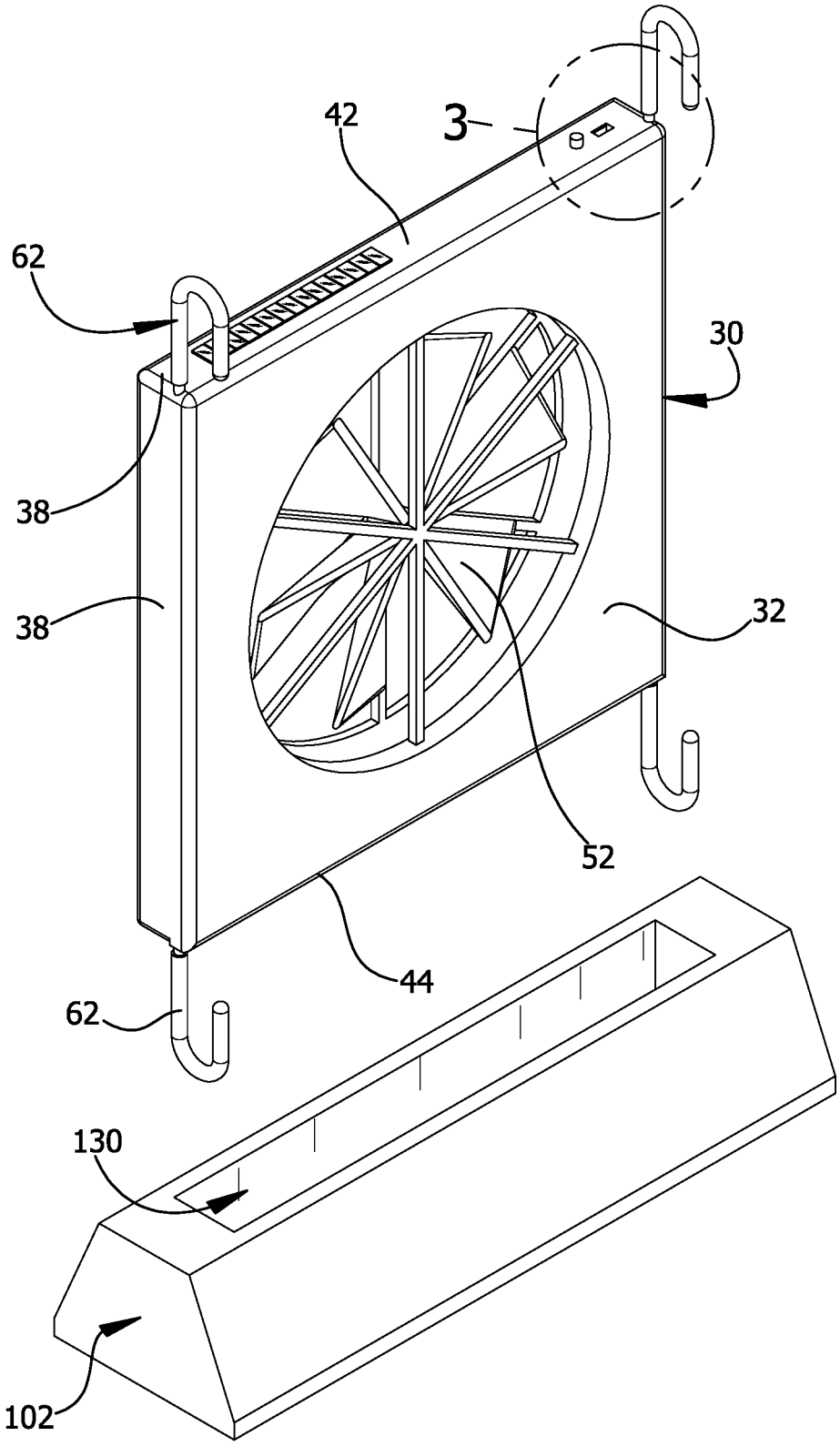
FIG. 1 is an isometric view of a patio chair fan assembly according to an embodiment of the disclosure.

With reference now to the drawings, and in particular to FIGS. 1 through 15 thereof, a new fan embodying the principles and concepts of an embodiment of the disclosure and generally designated by the reference numeral 10 will be described.

As best illustrated in FIGS. 1 through 15, the patio chair fan assembly 10 generally comprises a chair 12 having a plurality of support sections 14. Each support section of the plurality of support sections 14 has a plurality of openings 16. In embodiments, each support section of the plurality of support sections 14 includes at least one opening 16. The plurality of support sections 14 may include a seat 18 and a back rest 20.

The seat 18 may further comprise a perimeter edge 22 and a plurality of crossbars 24 that is coupled to and extends between opposing lateral sides of the perimeter edge 22. Each crossbar of the plurality of crossbars 24 is spaced from an adjacent crossbar of the plurality of crossbars 24 to define the plurality of openings 16 within the seat 18. The back rest 20 may be coupled to the perimeter edge 22 of the seat 18.

The back rest 20 may further comprise a peripheral edge 26 and a plurality of rods 28 that is coupled to and extends between opposing lateral ends of the peripheral edge 26. Each rod of the plurality of rods 28 is spaced from an adjacent rod of the plurality of rods 28 to define the plurality of openings 16 within the back rest 20.

A fan 30 is removably couplable to the chair 12. The fan 30 is aligned with at least one opening of the plurality of openings 16 in a selectable one of the plurality of support sections 14 wherein the fan 30 is configured to direct air through the at least one of the plurality of openings 16 in the selectable one of the plurality of support sections 14 to cool a user who is sitting on the chair 12.

The fan 30 may further comprise a housing 32 having a front wall 34, a rear wall 36, and a side wall 38 that is coupled to and extends between the front wall 34 and the rear wall 36 to define an interior space 40. The side wall 38 may have a top end 42 and a bottom end 44.

A power source 46 is positioned in the interior space 40. The power source 46 may comprise a battery. The battery may be rechargeable.

A processor 48 is positioned in the interior space 40. The processor 48 is electrically coupled to the power source 46 so that the power source 46 can power the processor 48.

A rotational motor 50 is positioned in the interior space 40. The rotational motor 50 is electrically coupled to the processor 48 wherein the processor 48 actuates the rotational motor 50.

A plurality of fan blades 52 is positioned in the interior space 40. The plurality of fan blades 52 is coupled to the housing 32. For example, the plurality of fan blades 52 may be coupled to at least one of the front wall 34 and the rear wall 36. The plurality of fan blades 52 is mechanically coupled to the rotational motor 50 wherein actuation of the rotational motor 50 rotates the plurality of fan blades 52. Rotation of the plurality of fan blades 52 is configured to direct air outwardly through the housing 32. For example, rotation of the plurality of fan blades 52 may be configured to direct air outwardly through the front wall 34 of the housing 32.

A plurality of cutouts 54 extends through the housing 32. The plurality of cutouts 54 is generally aligned with the plurality of fan blades 52. For example, the plurality of cutouts 54 may extend into the rear wall 36 and outwardly through the front wall 34 wherein rotation of the plurality of fan blades 52 is configured to direct air inwardly through the plurality of cutouts 54 positioned within the rear wall 36 and outwardly through the plurality of cutouts 54 positioned within the front wall 34. In another example, rotation of the plurality of fan blades 52 may be configured to direct air outwardly through the plurality of cutouts 54 positioned within the rear wall 36 and outwardly through the plurality of cutouts 54 positioned within the front wall 34.

The plurality of cutouts 54 may be centrally positioned on the front wall 34 and the rear wall 36. Each cutout of the plurality of cutouts 54 may be spaced from an adjacent cutout of the plurality of cutouts 54. Each cutout of the plurality of cutouts 54 may be triangular wherein the plurality of cutouts is arranged in a circle around the plurality of fan blades 52.

A switch 56 may be electrically coupled to the processor 48 wherein actuation of the switch 56 signals the processor 48 to actuate the rotational motor 50. The switch 56 may be positioned on the top end 42 of the side wall 38 of the housing 32. The switch 56 may comprise a button that signals the processor 48 to either actuate or deactivate the rotational motor 50.

A solar panel 58 may be electrically coupled to the power source 46 to transfer power to the power source 46. The solar panel 58 may be mounted to the top end 42 of the side wall 38, where the solar panel 58 will be exposed to sunlight. The solar panel 58 may be spaced from the switch 56 so that the user does not block the solar panel 58 from the sunlight when the user is actuating the switch 56.

A charging port 60 may be electrically coupled to the power source 46. The charging port 60 is generally configured to receive a power cable 61 for transferring power to the power source 46. The charging port 60 may be inset into the top end 42 of the side wall 38 and exposed within the top end 42 of the side wall 38. For example, the charging port 60 may be positioned adjacent to the switch 56. The charging port 60 may be a universal serial bus port.

A plurality of hooks 62 may extend outwardly from the housing 32 wherein the plurality of hooks 62 is configured to engage the selectable one of the plurality of support sections 14 of the chair 12 to removably couple the fan 30 to the chair 12. Each hook of the plurality of hooks 62 may be curved inwardly toward the front wall 34 of the housing 32 wherein the front wall 34 of the housing 32 is positioned adjacent to the selectable one of the plurality of support sections 14 when the fan 30 is coupled to the chair 12.

A first pair 64 of the plurality of hooks 62 may be positioned on the top end 42 of the side wall 38 of the housing 32 of the fan 30. The first pair 64 of the plurality of hooks 62 may further comprise a first hook 66 that is positioned adjacent to a junction between the top end 42 and a first lateral end 68 of the side wall 38 of the housing 32. For example, the first hook 66 may be positioned proximate to the solar panel 58. A second hook 70 of the first pair 64 of the plurality of hooks 62 may be positioned adjacent to a junction between the top end 42 and a second lateral end 72 of the side wall 38 of the housing 32. For example, the second hook 70 may be positioned proximate to the charging port 60.

A second pair 74 of the plurality of hooks 62 may be positioned on the bottom end 44 of the side wall 38 of the housing 32 of the fan 30. The second pair 74 of the plurality of hooks 62 may be aligned with the first pair 64 of the plurality of hooks 62 across the housing 32. The second pair 74 of the plurality of hooks 62 may further comprise a primary hook 76 that is aligned with the first hook 66 of the first pair 64 of the plurality of hooks 62. The primary hook 76 may be positioned adjacent to a junction between the bottom end 44 and the first lateral end 68 of the side wall 38 of the housing 32. A secondary hook 78 of the second pair 74 of the plurality of hooks 62 may be aligned with the second hook 70 of the first pair 64 of the plurality of hooks 62. The secondary hook 78 may be positioned adjacent to a junction between the bottom end 44 and the second lateral end 72 of the side wall 38 of the housing 32.

Each hook of the plurality of hooks 62 may further comprise a base end 80 that is coupled to the side wall 38 of the housing 32. An arm 82 may be coupled to and extending outwardly from the base end 80. The arm 82 may further comprise a straight portion 84 that is positioned adjacent to the base end 80. A terminal portion 86 may be parallel to the straight portion 84. The terminal portion 86 is generally spaced from the straight portion 84 wherein one of the perimeter edge 22 of the seat 18 and the peripheral edge 26 of the back rest 20 is positionable between the straight portion 84 and the terminal portion 86 of each hook of the plurality of hooks 62. An arcuate portion 88 is generally coupled to and extends between the straight portion 84 and the terminal portion 86. The arcuate portion 88 may have an outer edge 90 and an inner edge 92. The outer edge 90 may be convexly arcuate between the straight portion 84 and the terminal portion 86. The inner edge 92 may be concavely arcuate between the straight portion 84 and the terminal portion 86.

Figure 2:
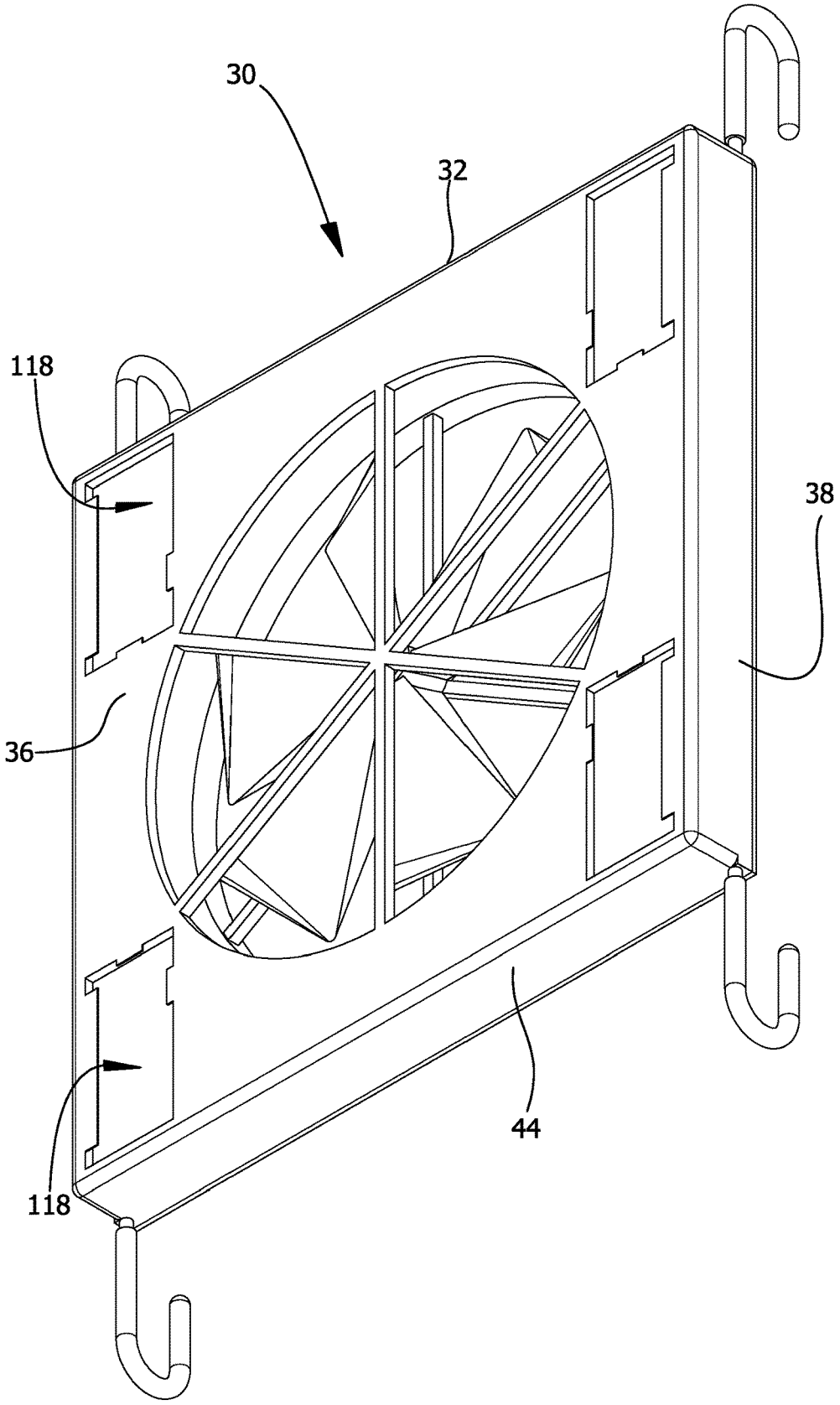
FIG. 2 is an isometric view of an embodiment of the disclosure.
Figure 3:
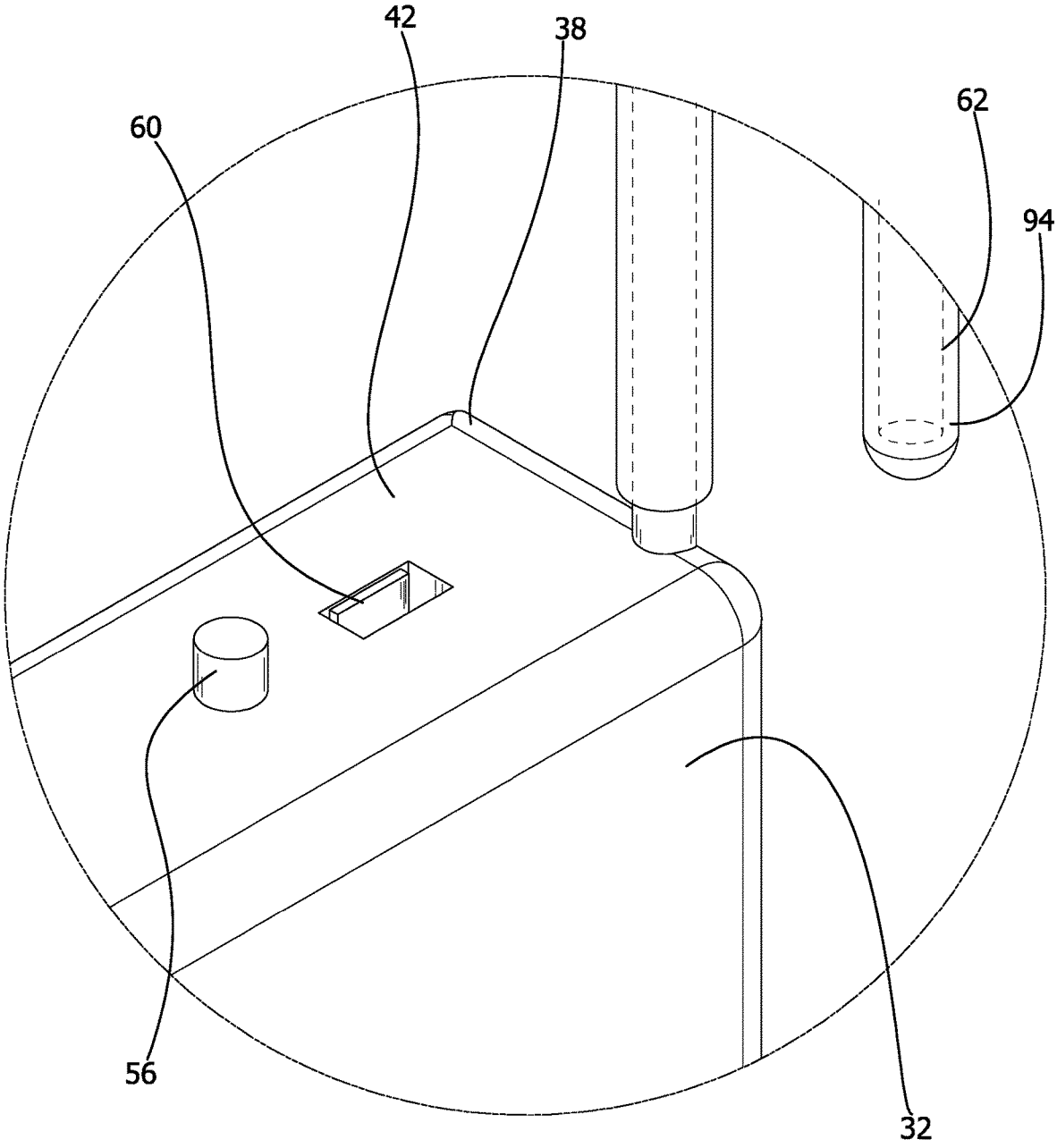
FIG. 3 is a detail view of an embodiment of the disclosure.
Figure 4:
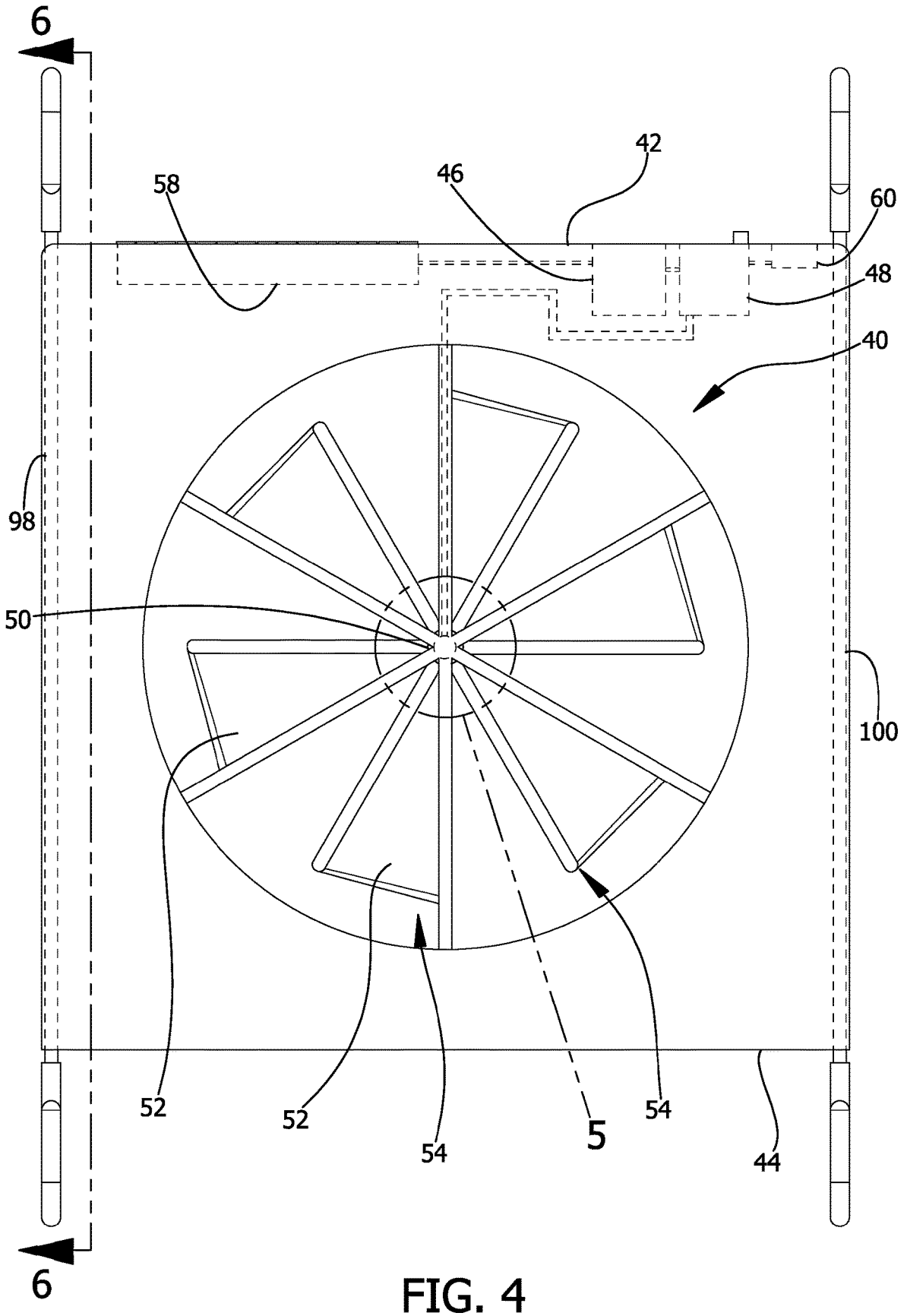
FIG. 4 is a front view of an embodiment of the disclosure.
Figure 5:
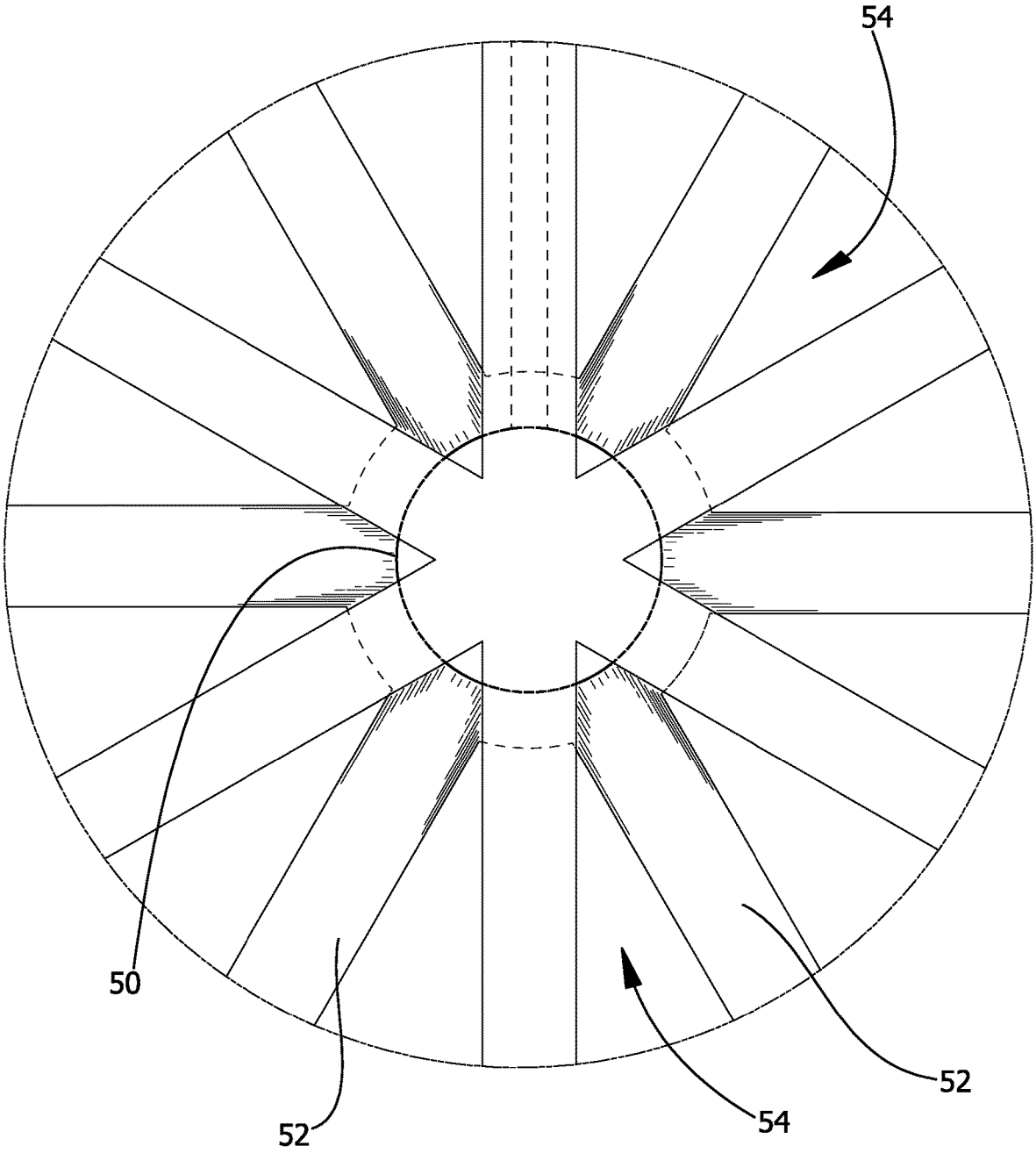
FIG. 5 is a detail view of an embodiment of the disclosure.
Figure 6:
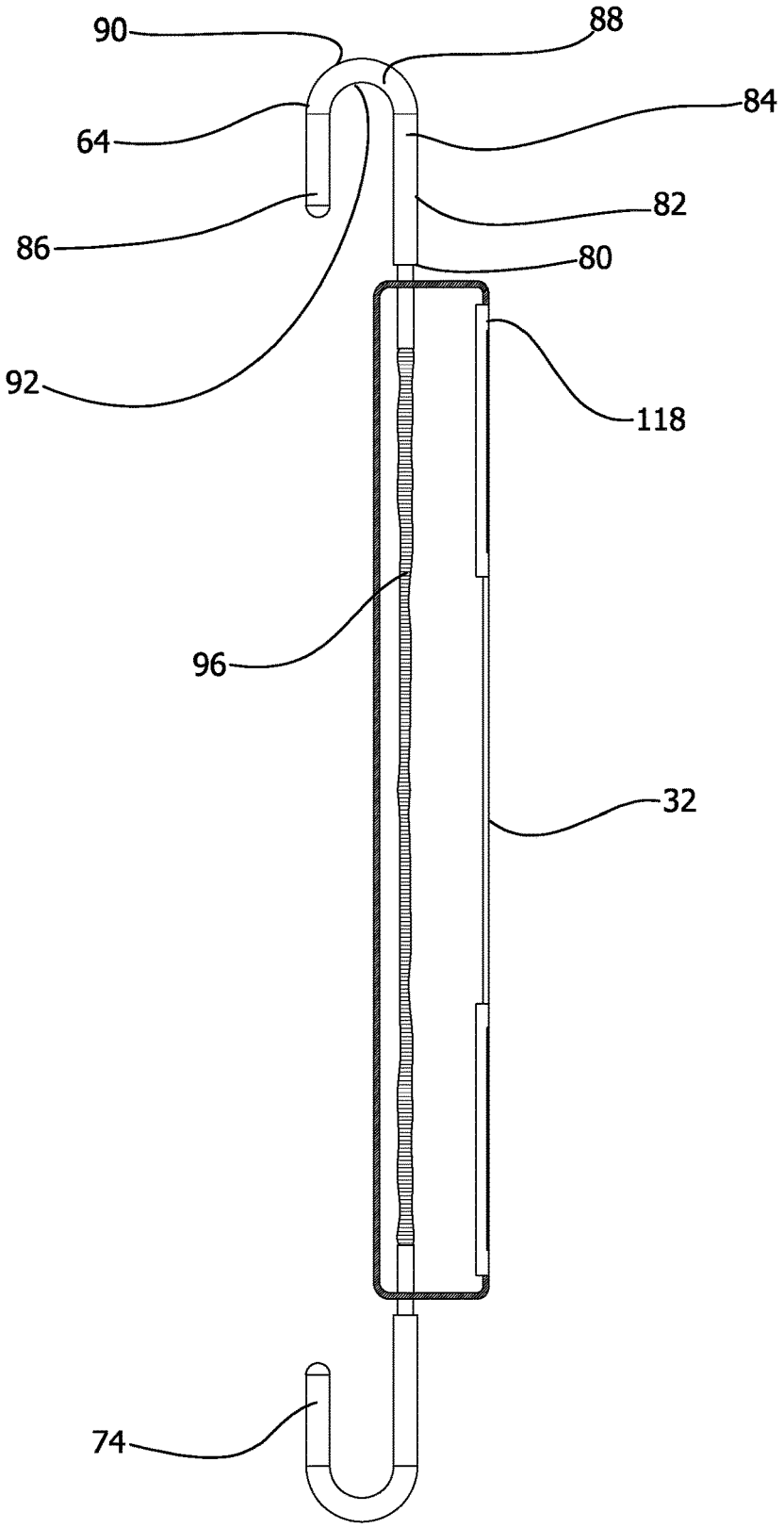
FIG. 6 is a cross-sectional view of an embodiment of the disclosure.
Figure 7:
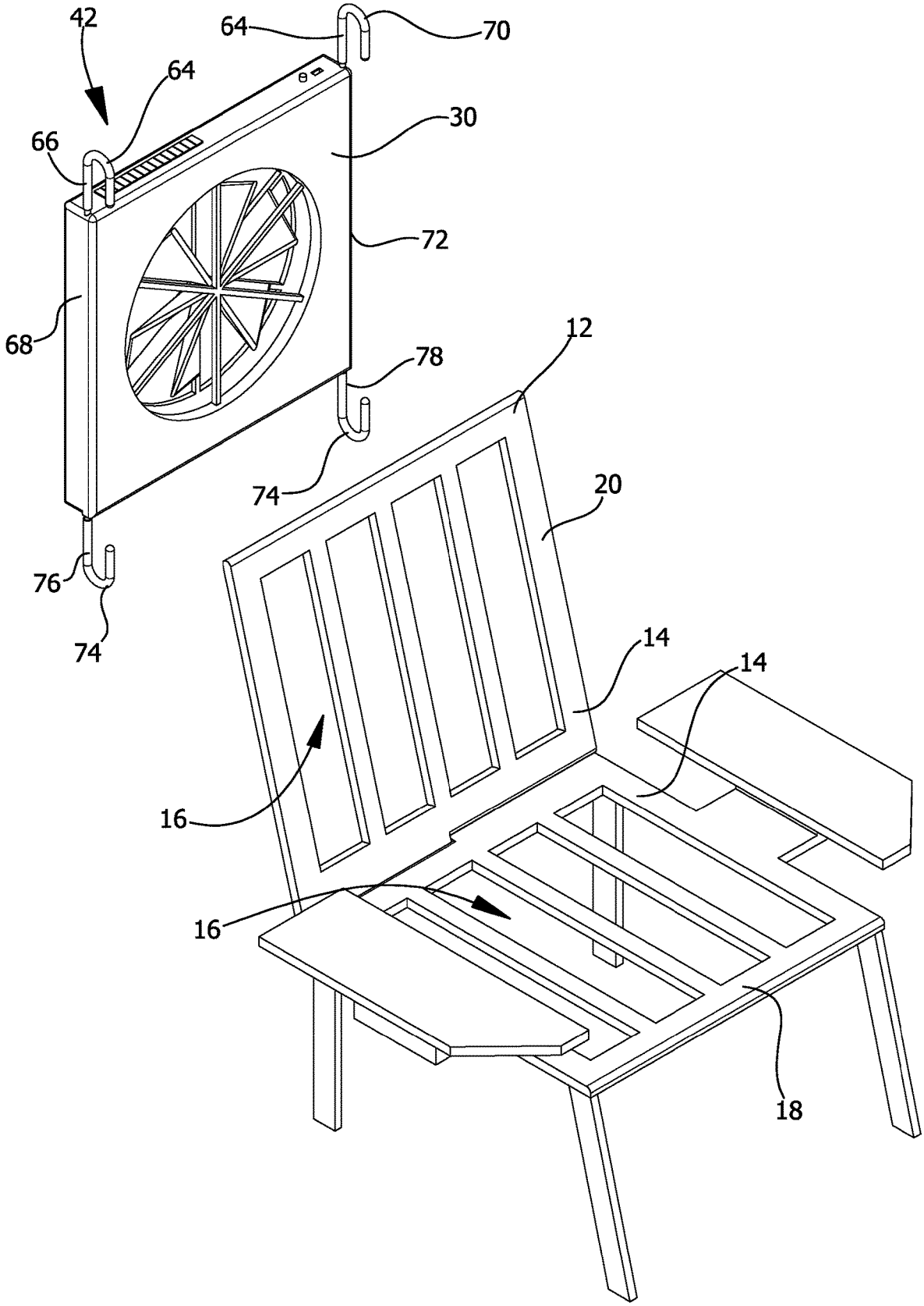
FIG. 7 is a perspective view of an embodiment of the disclosure.
Figure 8:
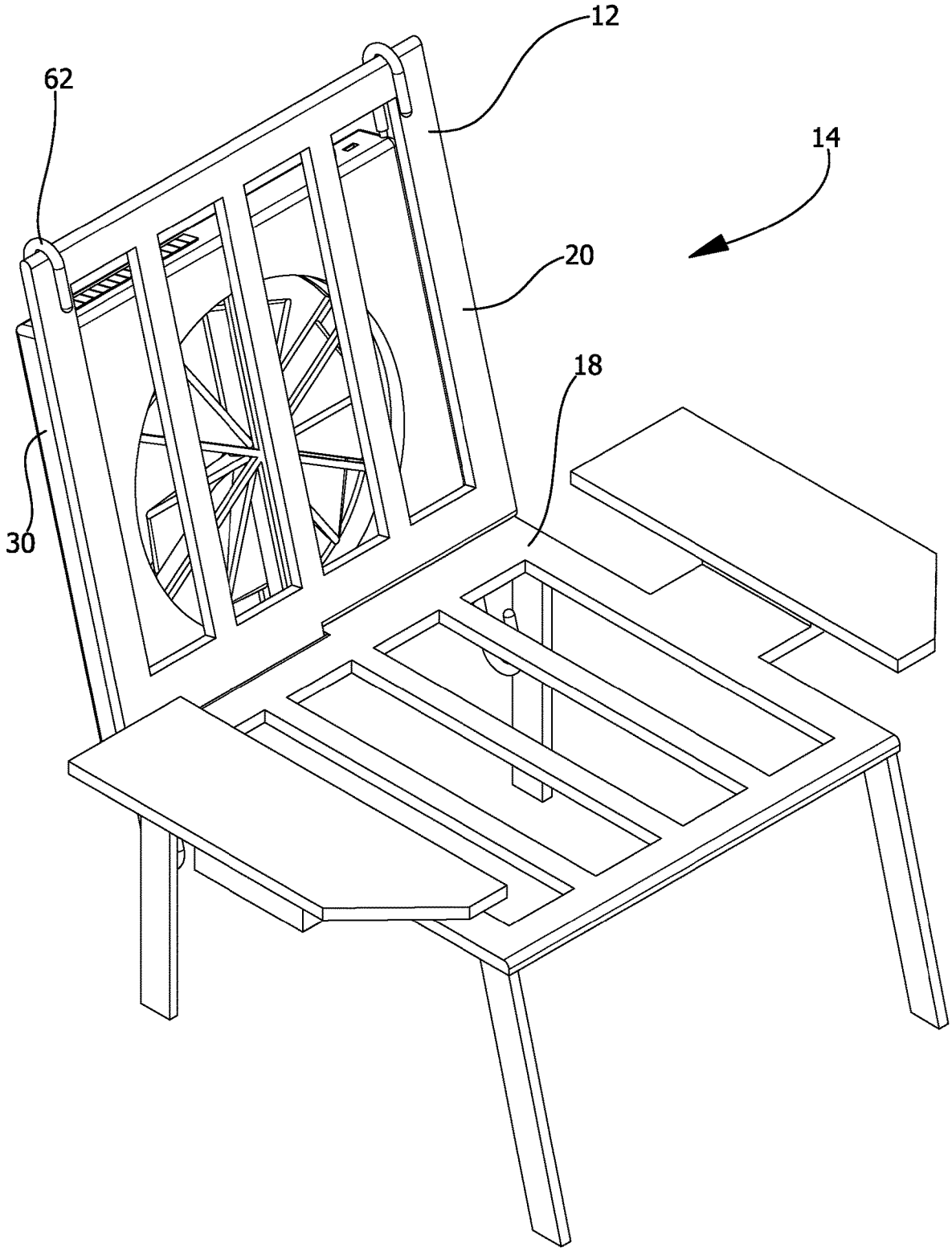
FIG. 8 is an in-use view of an embodiment of the disclosure.
Figure 9:
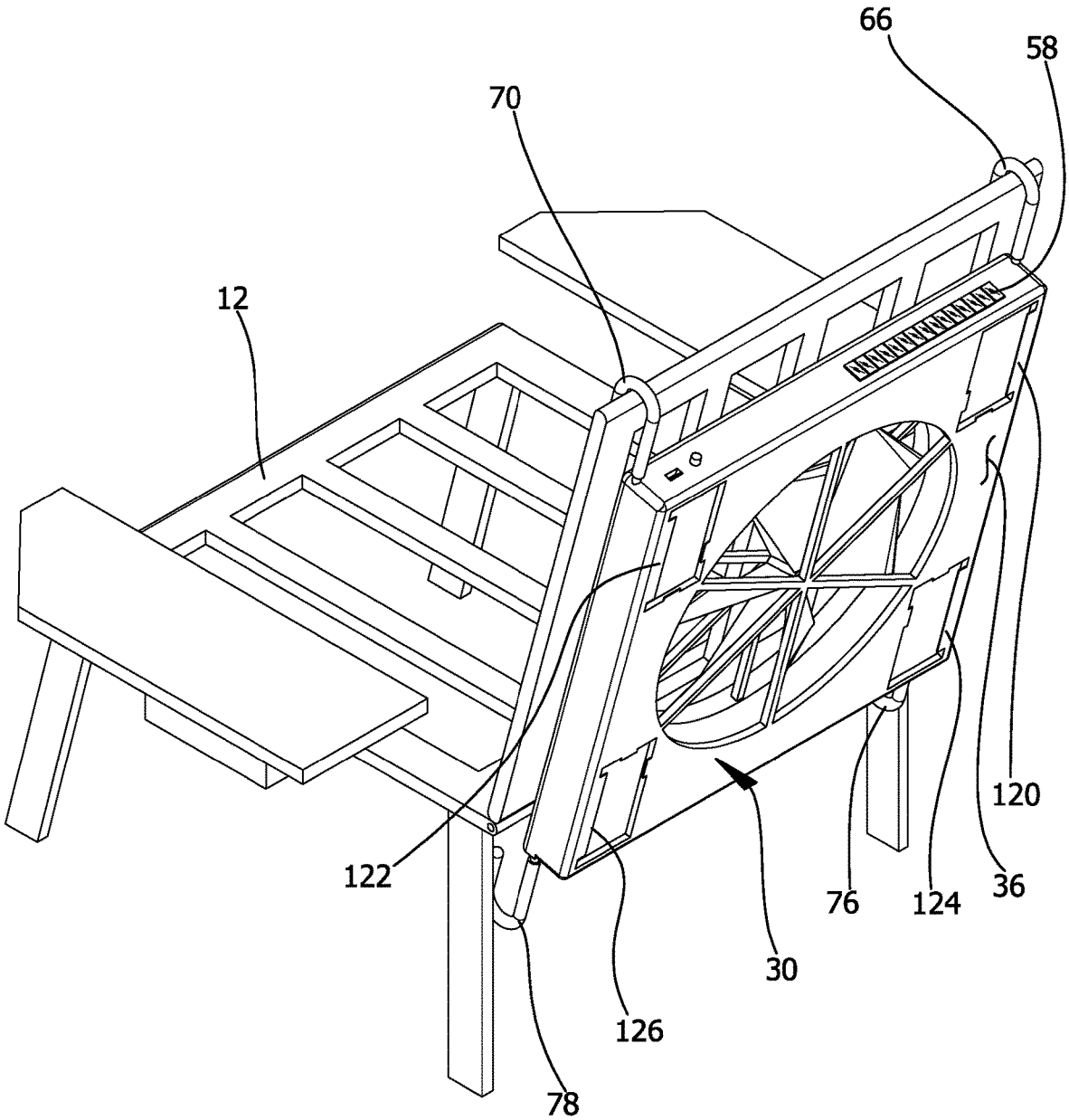
FIG. 9 is an in-use view of an embodiment of the disclosure.
Figure 10:
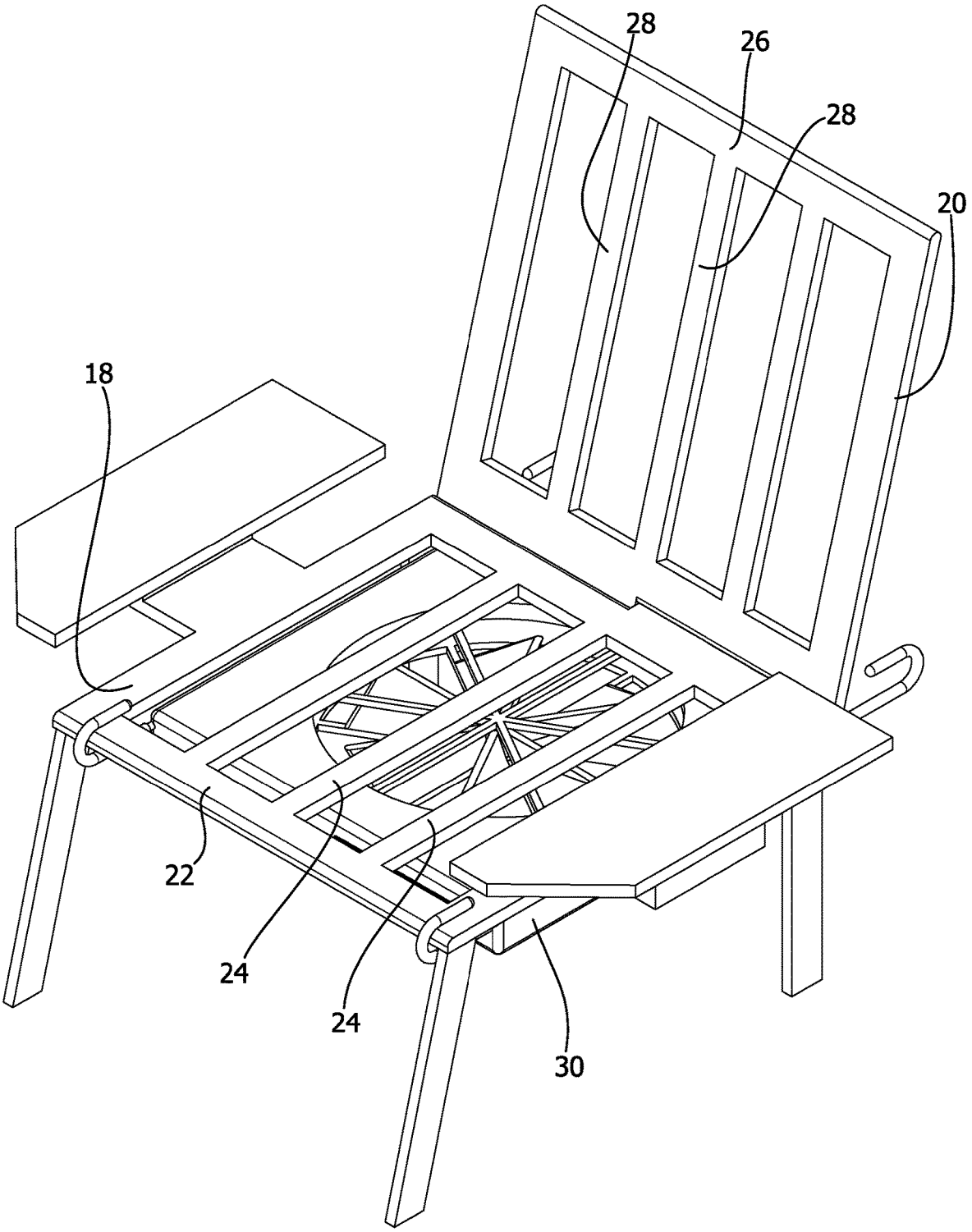
FIG. 10 is an in-use view of an embodiment of the disclosure.
Figure 11:
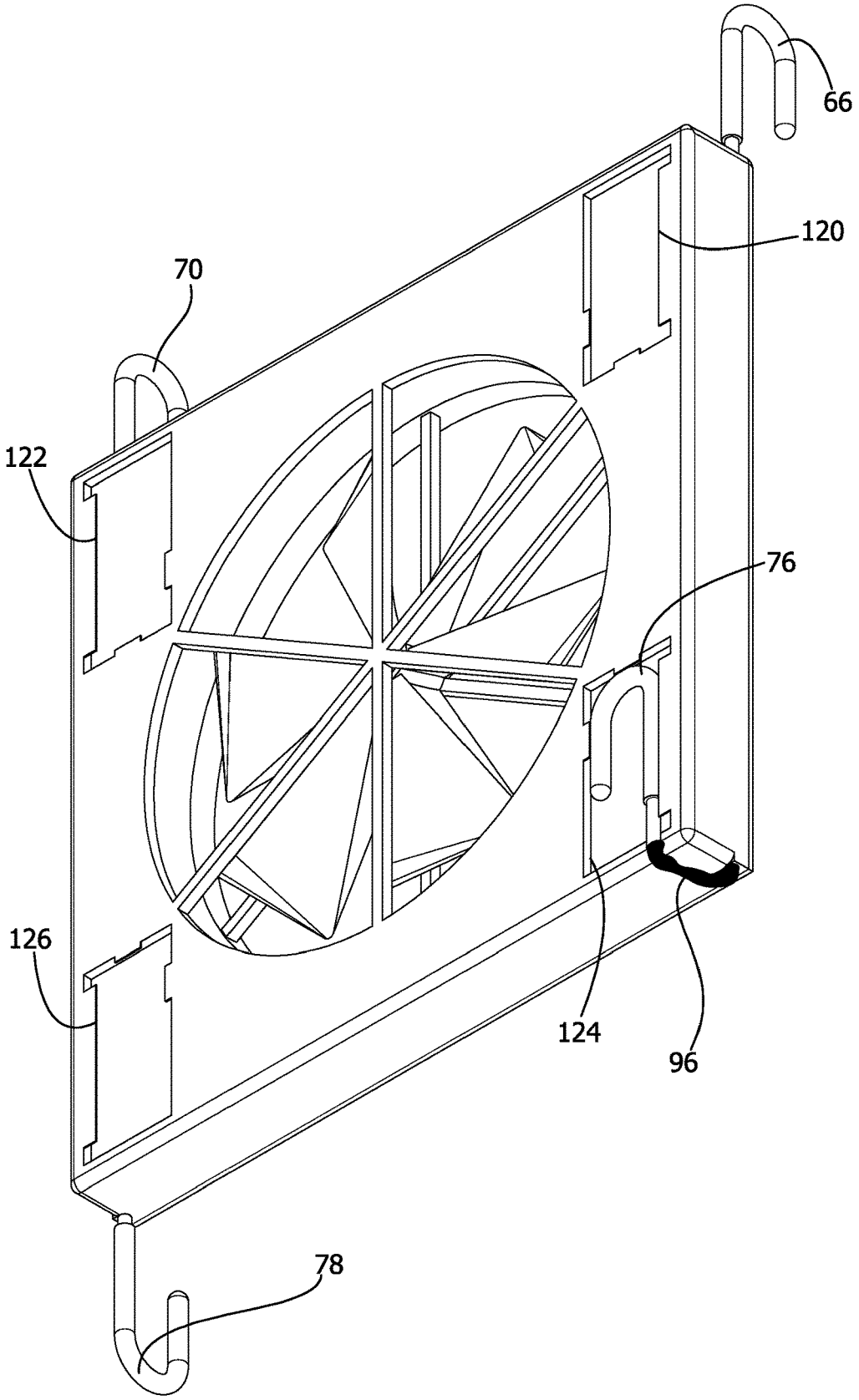
FIG. 11 is a block diagram view of an embodiment of the disclosure.
Figure 12:
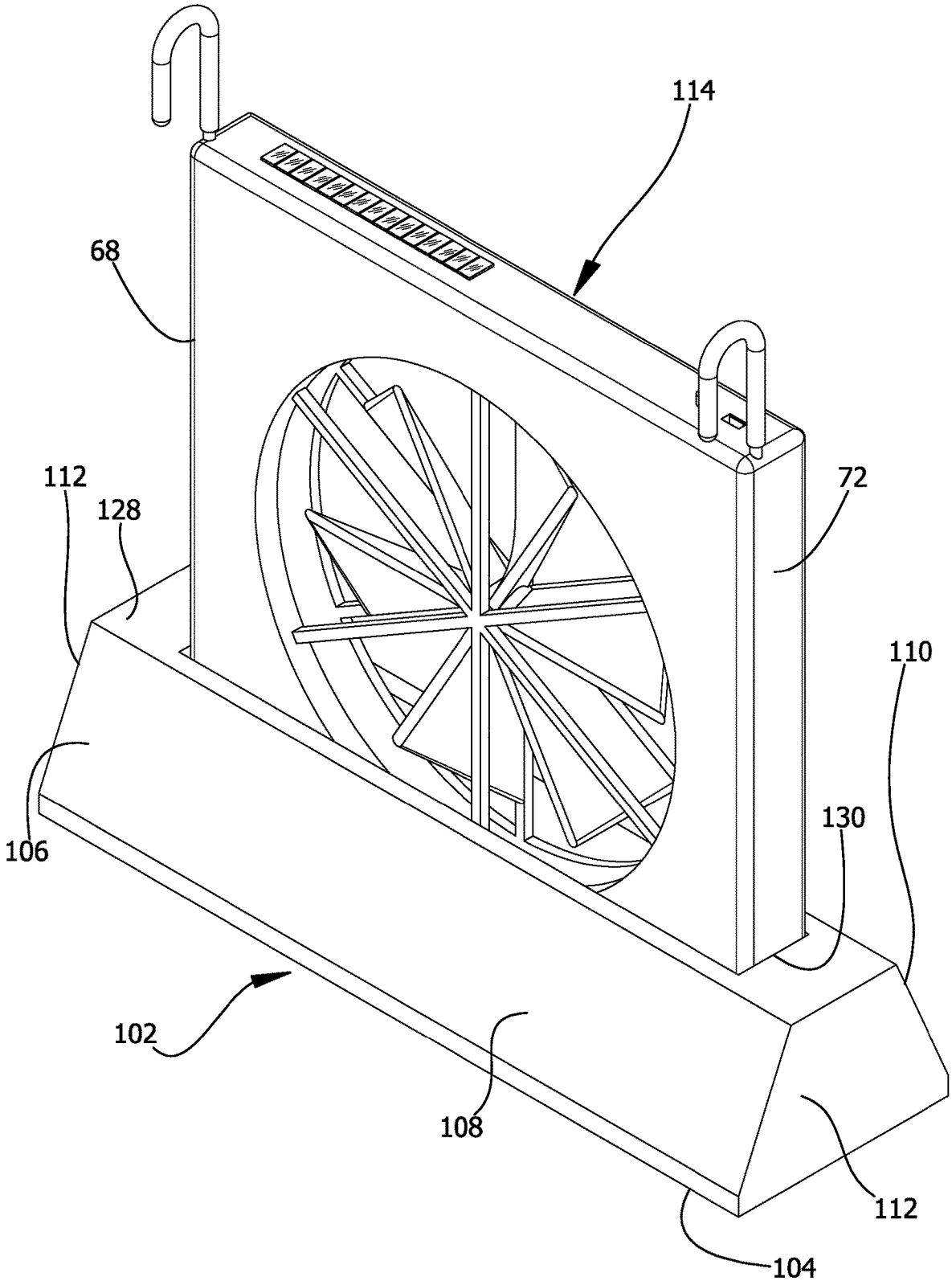
FIG. 12 is an isometric view of an embodiment of the disclosure.
Figure 13:
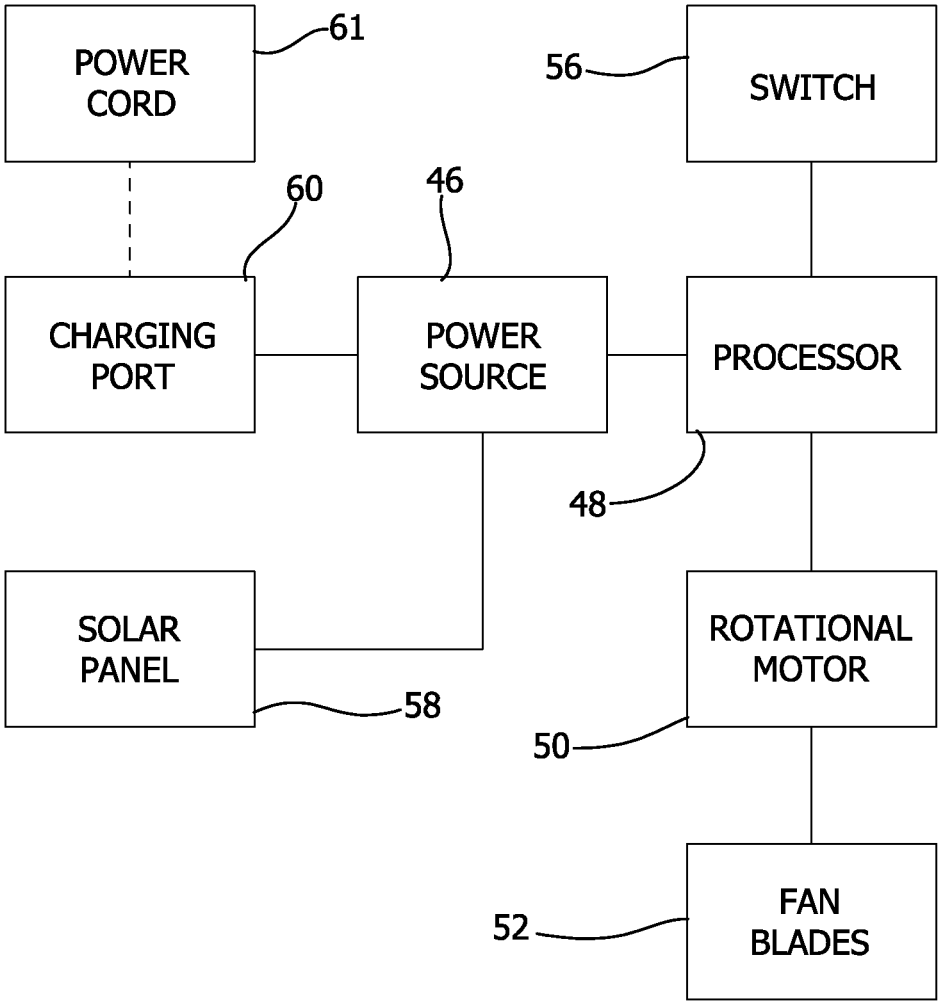
FIG. 13 is a block diagram of an embodiment of the disclosure.
Figure 14:
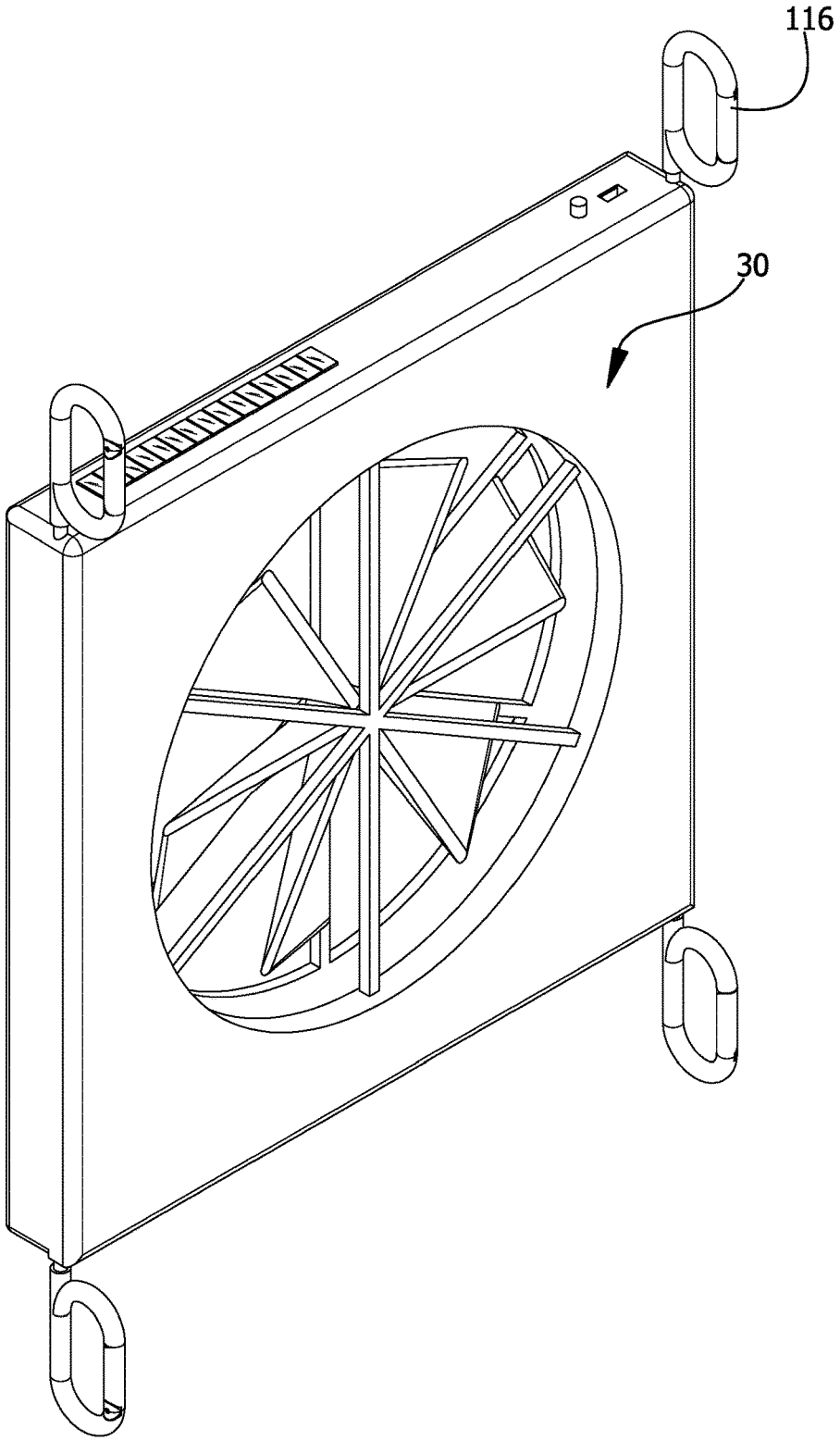
FIG. 14 is an isometric view of an embodiment of the disclosure.
Figure 15:
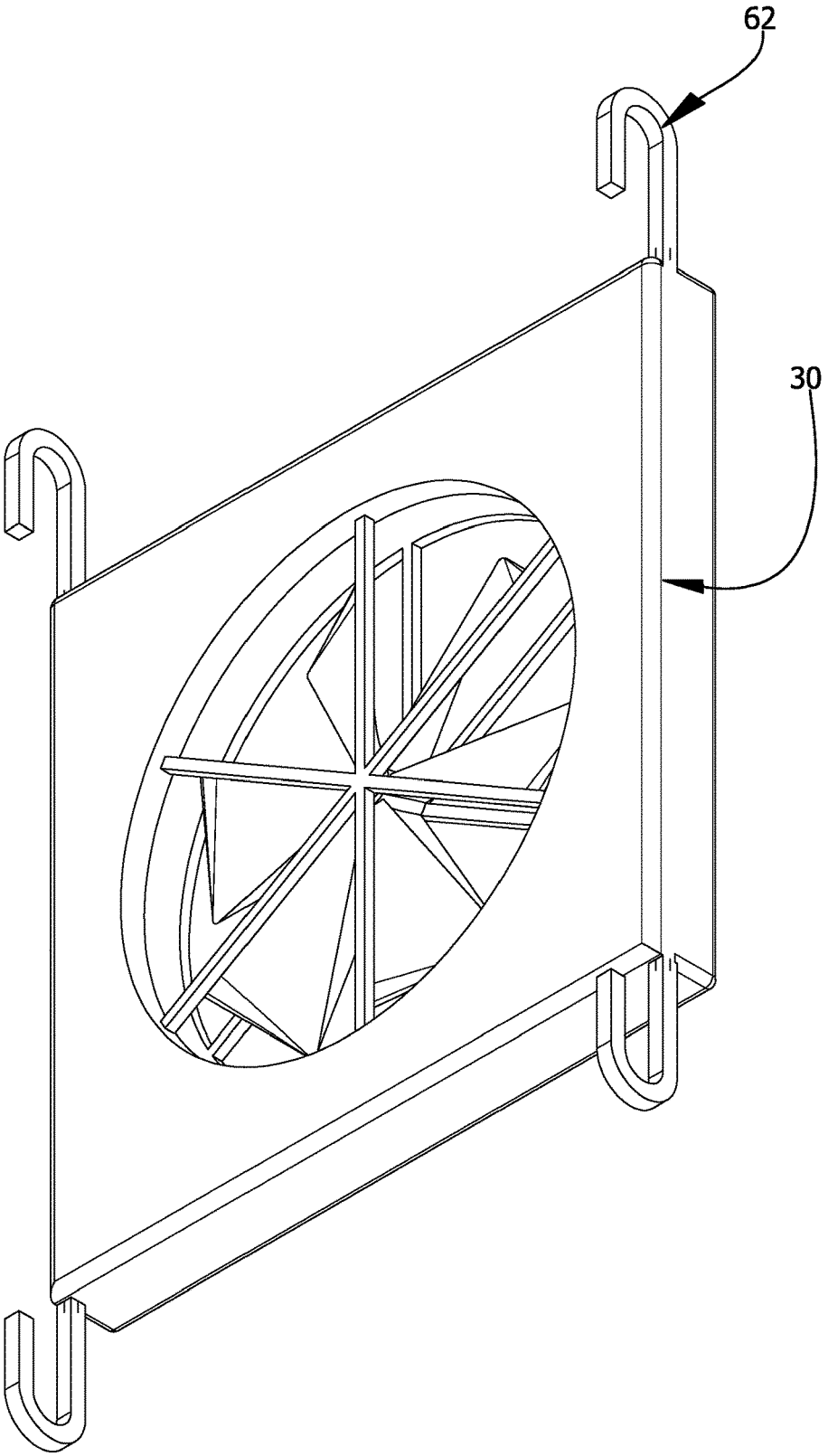
FIG. 15 is an isometric view of an embodiment of the disclosure.

The arm 82 of each hook of the plurality of hooks 62 may be rounded, as shown in FIG. 2. Alternatively, the arm 82 of each hook of the plurality of hooks 62 may be squared, as shown in FIG. 15. The shape and dimensions of the plurality of hooks 62 may vary wherein the shape of the plurality of hooks 62 is configured to facilitate the plurality of hooks 62 in engaging the selectable one of the plurality of support sections 14 of the chair 12 to removably couple the fan 30 to the chair 12. In some alternative embodiments, each hook of the plurality of hooks 62 may comprise a shackle or a clip, such as the carabiner 116 shown in FIG. 14. Each hook of the plurality of hooks 62 may comprise a rigid material that is configured to maintain a shape of the plurality of hooks 62.

A plurality of sleeves 94 may be coupled to the plurality of hooks 62. Each sleeve of the plurality of sleeves 94 is generally positioned on a respective hook of the plurality of hooks 62. Each sleeve of the plurality of sleeves 94 may comprise a resiliently compressible material that is configured to cushion the user from the rigid material of the respective hook of the plurality of hooks 62 when the user is sitting in the chair 12. The resiliently compressible material may further comprise a polymer material that is configured to increase friction between the respective hook of the plurality of hooks 62 and the chair 12. The increased friction from the polymer material may stabilize or retain a position of the fan 30 relative to the selectable one of the plurality of support sections 14.

A pair of cords 96 may couple the first pair 64 of the plurality of hooks 62 to the second pair 74 of the plurality of hooks 62. Each cord of the pair of cords 96 may comprise a resiliently deformable material wherein each cord of the pair of cords 96 is stretchable to extend a distance between the first pair 64 of the plurality of hooks 62 and the second pair 74 of the plurality of hooks 62. The pair of cords 96 may be positioned within the interior space 40 of the housing 32.

The pair of cords 96 may further comprise a first cord 98 extending between the first hook 66 of the first pair 64 of the plurality of hooks 62 and the primary hook 76 of the second pair 74 of the plurality of hooks 62. The first cord 98 may be aligned with the first lateral end 68 of the side wall 38 of the housing 32. A second cord 100 may extend between the second hook 70 of the first pair 64 of the plurality of hooks 62 and the secondary hook 78 of the second pair 74 of the plurality of hooks 62. The second cord 100 may be aligned with the second lateral end 72 of the side wall 38 of the housing 32.

A plurality of grooves 118 may extend into the rear wall 36 of the housing 32. Each groove of the plurality of grooves 118 is generally positioned proximate to a respective hook of the plurality of hooks 62 wherein each groove of the plurality of grooves 118 is configured to releasably retain the respective hook of the plurality of hooks 62 against the rear wall 36. The resiliently deformable material of the pair of cords 96 may be stretchable wherein the pair of cords 96 is configured to extend the distance between the first pair 64 of the plurality of hooks 62 and the second pair 74 of the plurality of hooks 62 wherein each hook of the plurality of hooks 62 is positionable within a respective groove of the plurality of grooves 118.

For example, a first groove 120 may be positioned proximate to the first hook 66. A second groove 122 may be positioned proximate to the second hook 70. A third groove 124 may be positioned proximate to the primary hook 76. A fourth groove 126 may be positioned proximate to the secondary hook 78.

A stand 102 may be removably couplable to the fan 30 wherein the stand 102 retains the fan 30 in an upright position when the stand 102 is coupled to the fan 30. For example, the stand 102 may comprise a lower panel 104. The lower panel 104 is generally planar. The lower panel 104 may be rectangular. A peripheral panel 106 may be coupled to and extend upwardly from the lower panel 104. The peripheral panel 106 may have a front surface 108, a rear surface 110, and a pair of lateral surfaces 112. The first lateral end 68 and the second lateral end 72 of the side wall 38 of the fan 30 may be parallel to the pair of lateral surfaces 112 of the stand 102 when the stand 102 is coupled to the fan 30. An upper panel 128 may be coupled to the peripheral panel 106 distally to the lower panel 104. The upper panel 128 may be rectangular. The upper panel 128 may have a width that is less than a width of the lower panel 104 wherein the front surface 108 and the rear surface 110 of the peripheral panel 106 are angled extending inwardly toward one another between the lower panel 104 and the upper panel 128.

A slot 130 may extend through the upper panel 128. The slot 130 may be rectangular. The slot 130 generally has a size that is complementary to a size of the fan 30 wherein the fan 30 is positionable in the slot 130 to couple the stand 102 to the fan 30. For example, one of the top end 42 and the bottom end 44 of the fan 30 may be positionable within the slot 130 wherein the stand 102 is configured to retain the fan 30 in the upright position.

In use, the fan 30 can be hung from the selectable one of the plurality of support sections 14. For example, the fan 30 may be hung from either the seat 18 or the back rest 20. In some embodiments, a first fan 30 can be hung from the seat 18 and a second fan 30 can be hung from the back rest 20. The rotational motor 50 may be actuated, for example by the switch 56, to direct air into the housing 32 through the plurality of cutouts 54 in the rear wall 36 and outwardly through the plurality of cutouts 54 in the front wall 34. The air movement caused by rotation of the plurality of fan blades 52 can cool the user who is sitting in the chair 12. Alternatively, the fan 30 may be positioned within the stand 102, for example next to the chair 12. When the plurality of hooks 62 is not in use, each hook of the plurality of hooks 62 can be releasably retained by a respective groove of the plurality of grooves 118 extending into the rear wall 36 of the fan 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A personal cooling system comprising:

a chair having a plurality of support sections, each support section of the plurality of support sections having an opening;

a fan being removably couplable to the chair, the fan being aligned with the opening in a selectable one of the plurality of support sections wherein the fan is configured to direct air through the opening in the selectable one of the plurality of support sections, the fan further comprising:

a housing having a front wall, a rear wall, and an interior space;

a power source being positioned in the interior space;

a processor being electrically coupled to the power source;

a rotational motor being positioned in the interior space, the rotational motor being electrically coupled to the processor wherein the processor actuates the rotational motor;

a plurality of fan blades being positioned in the interior space, the plurality of fan blades being coupled to the housing, the plurality of fan blades being mechanically coupled to the rotational motor wherein actuation of the rotational motor rotates the plurality of fan blades; and a plurality of cutouts extending into the rear wall and outwardly through the front wall, the plurality of cutouts being aligned with the plurality of fan blades wherein rotation of the plurality of fan blades is configured to direct air outwardly through the plurality of cutouts.

2. The personal cooling system of claim 1, the plurality of support sections further comprising a seat and a back rest.

3. The personal cooling system of claim 1, wherein rotation of the plurality of fan blades is configured to direct air outwardly through the front wall of the housing.

4. The personal cooling system of claim 1, wherein the plurality of cutouts is centrally positioned on each of the front wall and the rear wall.

5. The personal cooling system of claim 1, wherein each cutout of the plurality of cutouts is spaced from an adjacent cutout of the plurality of cutouts.

6. The personal cooling system of claim 1, wherein each cutout of the plurality of cutouts is triangular and wherein the plurality of cutouts is arranged in a circle.

7. The personal cooling system of claim 1, the fan further comprising a switch being electrically coupled to the processor wherein actuation of the switch signals the processor to actuate the rotational motor, the switch being positioned on the housing.

8. The personal cooling system of claim 1, the fan further comprising a solar panel being electrically coupled to the power source, the solar panel being positioned on the housing.

9. The personal cooling system of claim 1, the fan further comprising a charging port being electrically coupled to the power source, the charging port being inset into the housing, the charging port being exposed within the housing.

10. The personal cooling system of claim 1, further comprising a plurality of hooks extending outwardly from the housing of the fan wherein the plurality of hooks is configured to engage the selectable one of the plurality of support sections of the chair to removably couple the fan to the chair.

11. The personal cooling system of claim 10, wherein each hook of the plurality of hooks comprises a carabiner.

12. The personal cooling system of claim 10, further comprising a plurality of sleeves being coupled to the plurality of hooks, each sleeve of the plurality of sleeves being positioned on a respective hook of the plurality of hooks.

13. The personal cooling system of claim 10, wherein each hook of the plurality of hooks is curved inwardly toward the front wall of the housing wherein the front wall of the housing is positioned adjacent to the selectable one of the plurality of support sections when the fan is coupled to the chair.

14. The personal cooling system of claim 10, each hook of the plurality of hooks further comprising:

a base end being coupled to the housing; and an arm being coupled to and extending outwardly from the base end.

15. The personal cooling system of claim 14, the arm further comprising:

a straight portion being positioned adjacent to the base end;

a terminal portion being parallel to the straight portion, the terminal portion being spaced from the straight portion wherein the selectable one of the plurality of support sections is positionable between the straight portion and the terminal portion of each hook of the plurality of hooks; and an arcuate portion being coupled to and extending between the straight portion and the terminal portion.

16. The personal cooling system of claim 15, the arcuate portion further comprising an outer edge and an inner edge, the outer edge being convexly arcuate between the straight portion and the terminal portion, the inner edge being concavely arcuate between the straight portion and the terminal portion.

17. The personal cooling system of claim 10, the plurality of hooks further comprising a first pair of the plurality of hooks being positioned on a top end of the housing of the fan.

18. The personal cooling system of claim 17, the plurality of hooks further comprising a second pair of the plurality of hooks being positioned on a bottom end of the housing of the fan, the second pair of the plurality of hooks being aligned with the first pair of the plurality of hooks across the housing.

19. The personal cooling system of claim 18, further comprising a pair of cords coupling the first pair of the plurality of hooks to the second pair of the plurality of hooks, each cord of the pair of cords comprising a resiliently deformable material wherein each cord of the pair of cords is stretchable to extend a distance between the first pair of the plurality of hooks and the second pair of the plurality of hooks.

20. A personal cooling system comprising:

a chair having a plurality of support sections, each support section of the plurality of support sections having a plurality of openings, the plurality of support sections including a seat and a back rest;

the seat further comprising a perimeter edge and a plurality of crossbars being coupled to and extending between opposing lateral sides of the perimeter edge, each crossbar of the plurality of crossbars being spaced from an adjacent crossbar of the plurality of crossbars to define the plurality of openings within the seat, wherein the back rest is coupled to the perimeter edge of the seat;

the back rest further comprising a peripheral edge and a plurality of rods being coupled to and extending between opposing lateral ends of the peripheral edge, each rod of the plurality of rods being spaced from an adjacent rod of the plurality of rods to define the plurality of openings within the back rest;

a fan being removably couplable to the chair, the fan being aligned with at least one opening of the plurality of openings in a selectable one of the plurality of support sections wherein the fan is configured to direct air through the at least one of the plurality of openings in the selectable one of the plurality of support sections, the fan further comprising:

a housing having a front wall, a rear wall, and a side wall being coupled to and extending between the front wall and the rear wall to define an interior space, the side wall having a top end and a bottom end;

a power source being positioned in the interior space, the power source comprising a battery, the battery being rechargeable;

a processor being positioned in the interior space, the processor being electrically coupled to the power source;

a rotational motor being positioned in the interior space, the rotational motor being electrically coupled to the processor wherein the processor actuates the rotational motor;

a plurality of fan blades being positioned in the interior space, the plurality of fan blades being coupled to the front wall and the rear wall, the plurality of fan blades being mechanically coupled to the rotational motor wherein actuation of the rotational motor rotates the plurality of fan blades and wherein rotation of the plurality of fan blades is configured to direct air outwardly through the front wall of the housing;

a plurality of cutouts extending into the rear wall and outwardly through the front wall, the plurality of cutouts being aligned with the plurality of fan blades wherein rotation of the plurality of fan blades is configured to direct air inwardly through the plurality of cutouts positioned within the rear wall and outwardly through the plurality of cutouts positioned within the front wall, the plurality of cutouts being centrally positioned on the front wall and the rear wall, each cutout of the plurality of cutouts being spaced from an adjacent cutout of the plurality of cutouts, each cutout of the plurality of cutouts being triangular wherein the plurality of cutouts is arranged in a circle;

a switch being electrically coupled to the processor wherein actuation of the switch signals the processor to actuate the rotational motor, the switch being positioned on the top end of the side wall, the switch comprising a button;

a solar panel being electrically coupled to the power source, the solar panel being mounted to the top end of the side wall, the solar panel being spaced from the switch;

a charging port being electrically coupled to the power source, the charging port being inset into the top end of the side wall, the charging port being exposed within the top end of the side wall, the charging port being a universal serial bus port, the charging port being positioned adjacent to the switch;

a plurality of hooks extending outwardly from the housing wherein the plurality of hooks is configured to engage the selectable one of the plurality of support sections of the chair to removably couple the fan to the chair, each hook of the plurality of hooks being curved inwardly toward the front wall of the housing wherein the front wall of the housing is positioned adjacent to the selectable one of the plurality of support sections when the fan is coupled to the chair, the plurality of hooks further comprising:

a first pair of the plurality of hooks being positioned on the top end of the side wall of the housing of the fan, the first pair of the plurality of hooks further comprising:

a first hook being positioned adjacent to a junction between the top end and a first lateral end of the side wall of the housing, the first hook being positioned proximate to the solar panel;

a second hook being positioned adjacent to a junction between the top end and a second lateral end of the side wall of the housing, the second hook being positioned proximate to the charging port;

a second pair of the plurality of hooks being positioned on the bottom end of the side wall of the housing of the fan, the second pair of the plurality of hooks being aligned with the first pair of the plurality of hooks across the housing, the second pair of the plurality of hooks further comprising:

a primary hook being aligned with the first hook, the primary hook being positioned adjacent to a junction between the bottom end and the first lateral end of the side wall of the housing;

a secondary hook being aligned with the second hook, the secondary hook being positioned adjacent to a junction between the bottom end and the second lateral end of the side wall of the housing;

each hook of the plurality of hooks further comprising:

a base end being coupled to the side wall of the housing;

an arm being coupled to and extending outwardly from the base end, the arm further comprising:

a straight portion being positioned adjacent to the base end;

a terminal portion being parallel to the straight portion, the terminal portion being spaced from the straight portion wherein one of the perimeter edge of the seat and the peripheral edge of the back rest is positionable between the straight portion and the terminal portion of each hook of the plurality of hooks;

an arcuate portion being coupled to and extending between the straight portion and the terminal portion, the arcuate portion having an outer edge and an inner edge, the outer edge being convexly arcuate between the straight portion and the terminal portion, the inner edge being concavely arcuate between the straight portion and the terminal portion;

each hook of the plurality of hooks comprising a rigid material being configured to maintain a shape of the plurality of hooks;

a plurality of sleeves being coupled to the plurality of hooks, each sleeve of the plurality of sleeves being positioned on a respective hook of the plurality of hooks, each sleeve of the plurality of sleeves comprising a resiliently compressible material being configured to cushion a user from the rigid material of the respective hook of the plurality of hooks when the user is sitting in the chair, the resiliently compressible material comprising a polymer material being configured to increase friction between the respective hook of the plurality of hooks and the chair;

a pair of cords coupling the first pair of the plurality of hooks to the second pair of the plurality of hooks, each cord of the pair of cords comprising a resiliently deformable material wherein each cord of the pair of cords is stretchable to extend a distance between the first pair of the plurality of hooks and the second pair of the plurality of hooks, the pair of cords being positioned within the interior space of the housing, the pair of cords further comprising:

a first cord extending between the first hook of the first pair of the plurality of hooks and the primary hook of the second pair of the plurality of hooks, the first cord being aligned with the first lateral end of the side wall of the housing;

a second cord extending between the second hook of the first pair of the plurality of hooks and the secondary hook of the second pair of the plurality of hooks, the second cord being aligned with the second lateral end of the side wall of the housing;

a plurality of grooves extending into the rear wall of the housing, each groove of the plurality of grooves being positioned proximate to a respective hook of the plurality of hooks wherein the each groove of the plurality of grooves is configured to releasably retain the respective hook of the plurality of hooks against the rear wall, the resiliently deformable material of the pair of cords being stretchable wherein the pair of cords is configured to extend the distance between the first pair of the plurality of hooks and the second pair of the plurality of hooks wherein each hook of the plurality of hooks is positionable within a respective groove of the plurality of grooves, the plurality of grooves including:

a first groove being positioned proximate to the first hook;

a second groove being positioned proximate to the second hook;

a third groove being positioned proximate to the primary hook;

a fourth groove being positioned proximate to the secondary hook;

a stand being removably couplable to the fan wherein the stand retains the fan in an upright position when the stand is coupled to the fan, the stand comprising:

a lower panel being planar, the lower panel being rectangular;

a peripheral panel being coupled to and extending upwardly from the lower panel, the peripheral panel having a front surface, a rear surface, and a pair of lateral surfaces, the first lateral end and the second lateral end of the side wall of the fan being parallel to the pair of lateral surfaces of the stand when the stand is coupled to the fan;

an upper panel being coupled to the peripheral panel distally to the lower panel, the upper panel being rectangular, the upper panel having a width being less than a width of the lower panel wherein the front surface and the rear surface are angled extending inwardly toward one another between the lower panel and the upper panel;

a slot extending through the upper panel, the slot being rectangular, the slot having a size being complementary to a size of the fan wherein the fan is positionable in the slot to couple the stand to the fan, one of the top end and the bottom end of the fan being positionable within the slot wherein the stand is configured to retain the fan in the upright position.

* * * * *